US009970340B2

(12) United States Patent
Abram et al.

(10) Patent No.: US 9,970,340 B2
(45) Date of Patent: May 15, 2018

(54) VEHICLE EXHAUST SYSTEM WITH RESONANCE DAMPING

(71) Applicant: Faurecia Emissions Control Technologies, USA, LLC, Columbus, IN (US)

(72) Inventors: Kwin Abram, Columbus, IN (US); Joseph E. Callahan, Greenwood, IN (US); Tommy Pham, Avon, IN (US)

(73) Assignee: Faurecia Emissions Control Technologies, USA, LLC, Columbus, IN (US)

( * ) Notice: Subject to any disclaimer, the term of this patent is extended or adjusted under 35 U.S.C. 154(b) by 0 days. days.

(21) Appl. No.: 14/763,216

(22) PCT Filed: Feb. 12, 2013

(86) PCT No.: PCT/US2013/025693

§ 371 (c)(1),
(2) Date: Jul. 24, 2015

(87) PCT Pub. No.: WO2014/126548

PCT Pub. Date: Aug. 21, 2014

(65) Prior Publication Data

US 2015/0361841 A1 Dec. 17, 2015

(51) Int. Cl.
*F01N 1/02* (2006.01)
*F01N 13/08* (2010.01)
(Continued)

(52) U.S. Cl.
CPC ..... *F01N 1/023* (2013.01); *F01N 1/02* (2013.01); *F01N 1/026* (2013.01); *F01N 1/082* (2013.01); *F01N 1/083* (2013.01); *F01N 13/08* (2013.01)

(58) Field of Classification Search
CPC . F01N 1/023; F01N 1/02; F01N 1/026; F01N 1/082; F01N 1/083; F01N 1/06; F01N 1/065; F01N 13/08
(Continued)

(56) References Cited

U.S. PATENT DOCUMENTS 2,297,046 A * 9/1942 Bourne ..... F01N 1/006 110/184
2,955,671 A * 10/1960 Hans ..... F02M 35/1233 123/198 E
(Continued)

FOREIGN PATENT DOCUMENTS

CN 2918745 Y 7/2007
DE 103 37 110 A1 3/2005
(Continued)

OTHER PUBLICATIONS

International Search Report from PCT/US2013/025693.
(Continued)

*Primary Examiner* — Edgardo San Martin
(74) *Attorney, Agent, or Firm* — Carlson, Gaskey & Olds, P.C.

(57) ABSTRACT

A vehicle exhaust system includes an exhaust component having an outer surface and an inner surface that defines an internal exhaust component cavity. At least one bleed hole is formed in the exhaust component to reduce a resonance frequency. The bleed hole comprises a discontinuous opening into the exhaust component cavity.

38 Claims, 9 Drawing Sheets

(51) Int. Cl.
*F01N 1/08* (2006.01)
*F01N 1/00* (2006.01)

(58) Field of Classification Search
USPC ..... 181/228, 227, 206, 247, 248, 249, 250; 123/184.53, 184.57
See application file for complete search history.

(56) References Cited

U.S. PATENT DOCUMENTS 4,209,076 A * 6/1980 Franco ..... F01N 1/02 181/272
5,040,495 A * 8/1991 Harada ..... F02M 35/1266 123/184.57
5,189,266 A 2/1993 Sasaki et al.
5,317,112 A * 5/1994 Lee ..... F02M 35/1255 181/250
5,493,080 A * 2/1996 Moss ..... F01N 1/003 181/227
5,576,522 A * 11/1996 Taso ..... H04R 1/2819 181/156
5,979,598 A 11/1999 Wolf et al.
6,341,663 B1 * 1/2002 Alex ..... F01N 1/006 181/249
6,517,595 B2 * 2/2003 Kino ..... F02M 35/10118 123/198 E
6,732,509 B2 * 5/2004 Shiga ..... F01N 1/02 123/184.53
6,959,678 B2 * 11/2005 Kino ..... B29C 65/568 123/184.53
7,107,959 B2 * 9/2006 Kino ..... F02M 35/1216 123/184.57
7,461,718 B2 * 12/2008 Dedieu ..... H04R 1/2819 181/148
7,556,123 B2 * 7/2009 Ido ..... F01N 1/023 123/184.57
7,942,239 B2 * 5/2011 Huff ..... F01N 1/02 181/250
7,958,966 B2 6/2011 Smith
7,971,681 B2 7/2011 Bochnaker et al.
8,132,552 B2 * 3/2012 Matsumoto ..... F02M 35/1238 123/184.61
8,528,692 B2 * 9/2013 Teshima ..... F02M 35/10144 123/184.53
8,550,122 B2 10/2013 Derry et al.
8,550,208 B1 10/2013 Potokar
2003/0152239 A1 * 8/2003 Graefenstein ..... G10K 11/1788 381/71.5
2004/0094360 A1 * 5/2004 Toyoshima ..... F01N 1/02 181/249
2004/0226772 A1 * 11/2004 Hirose ..... F02M 35/1238 181/258
2005/0205352 A1 * 9/2005 Colin ..... F01N 1/06 181/249
2005/0224283 A1 * 10/2005 Yokoi ..... F01N 1/06 181/268
2007/0205044 A1 9/2007 Bae et al.
2008/0035421 A1 2/2008 Feist et al.
2008/0041657 A1 2/2008 Ido et al.
2008/0230306 A1 * 9/2008 Ichikawa ..... F02M 35/1272 181/229
2010/0307143 A1 12/2010 Colette
2011/0074067 A1 3/2011 Khami
2011/0083924 A1 * 4/2011 Park ..... F01N 1/04 181/227
2015/0101885 A1 * 4/2015 An ..... F01N 13/02 181/228
2016/0169070 A1 * 6/2016 Horr ..... F01N 13/08 181/250

FOREIGN PATENT DOCUMENTS

DE 10 2011 011 060 A1 8/2012
EP 1170499 A1 1/2002
EP 1507071 A1 2/2005
EP 1953354 A1 8/2008
EP 2017440 A1 1/2009
EP 2388504 A1 11/2011
EP 2535534 A1 12/2012
EP 2541034 A1 1/2013
FR 2814778 A1 4/2002
FR 2867234 A1 9/2005
JP 60125764 A 7/1985
JP 64034460 U 8/1987
JP 05-240120 A 9/1993
JP 2007285259 A 11/2007
KR 1020000053584 A 8/2000
KR 1020020019062 A 3/2002
KR 100372706 B1 2/2003
KR 1020100085537 A 7/2010
KR 1020110079663 A 7/2011

OTHER PUBLICATIONS

Supplementary European Search Report for European Application No. 13874964.3 dated Sep. 6, 2016.
Vorteile Besonderheiten et al., Silent Stars, Microsorber, "Mico-perforated sheets and acrylic glass panels", Kaefer Construction GmbH, Getreidestrasse 3, D-28217 Bremen, Germany, www.microsober.com. No Date.

* cited by examiner

VEHICLE EXHAUST SYSTEM WITH RESONANCE DAMPING

TECHNICAL FIELD

The subject invention relates to a vehicle exhaust system with resonance damping to reduce noise.

BACKGROUND OF THE INVENTION

Vehicle exhaust systems direct exhaust gases generated by an internal combustion engine to the external environment. These systems are comprised of various components such as pipes, converters, catalysts, filters, etc. The overall system and/or the components are capable of generating undesirable noise as a result of resonating frequencies. Different approaches have been used to address this issue.

For example, components such as mufflers, resonators, valves, etc., have been incorporated into exhaust systems in an attempt to attenuate certain resonance frequencies generated by the exhaust system. The disadvantage of adding additional components is that it is expensive and increases weight. Further, adding components introduces new sources for noise generation.

Another approach utilizes active noise control (ANC) in an attempt to attenuate the undesirable noise. ANC systems utilize components such as microphones and speakers to generate noise that cancels out the undesirable noise. ANC systems can be complex, very expensive, and can take up significant amounts of packaging space. Further, these systems are not always effective in attenuating wide ranges of resonance frequencies.

SUMMARY OF THE INVENTION

A vehicle exhaust system includes an exhaust component having an outer surface and an inner surface that defines an internal exhaust component cavity. At least one bleed hole is formed in the exhaust component to reduce a resonance frequency. The bleed hole comprises a discontinuous opening into the exhaust component cavity.

In one example, the discontinuous opening into the exhaust path is provided by a porous member that is associated with the at least one bleed hole.

In one example, the porous member comprises a sheet of microperforated material that is attached to the pipe and covers the at least one bleed hole. The sheet of microperforated material can be mounted to be flush with or offset from the pipe, for example.

In one example, the porous member comprises a boss located at the bleed hole, with the boss being formed from a powdered or sintered metal material.

In one example, the exhaust component comprises a pipe extending from a first pipe end to a second pipe end. The pipe is defined by an overall length, and the bleed hole is located at an anti-node position that is approximately 25% of the overall length from either the first or second pipe end.

In one example, the bleed hole is located at an anti-node position that is approximately 50% of the overall length from either the first or second pipe end In one example, the exhaust component comprises a muffler having a housing extending from a first end to a second end and that provides the inner and outer surfaces to define an internal muffler volume. The muffler includes a first end cap associated with the first end and a second end cap associated with the second end. The bleed hole is located in the housing and/or within at least one of the first and second end caps.

In one example, the exhaust component comprises a Helmholtz resonator.

These and other features may be best understood from the following drawings and specification.

DETAILED DESCRIPTION

Figure 1:
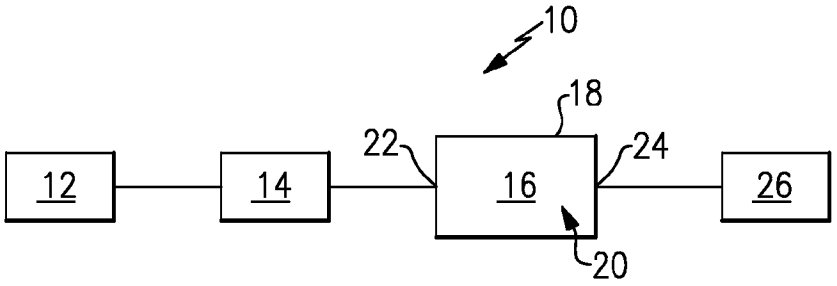
FIG. 1 schematically illustrates one example of an exhaust system with a muffler mounted according to the subject invention.

FIG. 1 shows a vehicle exhaust system 10 that conducts hot exhaust gases generated by an internal combustion engine 12 through exhaust components 14 to reduce emissions and control noise as known. The exhaust system 10 also includes at least one muffler 16 that functions to attenuate exhaust noise. The muffler 16 includes an outer housing 18 that defines an internal cavity 20. The muffler 16 has an inlet end 22 and an outlet end 24. Exhaust gases exits the outlet end 24 and is directed to downstream exhaust components 26, which can include a tailpipe, for example, through which exhaust gases exit to atmosphere.

The exhaust components 14 and 26 can include diesel oxidation catalysts (DOC), selective catalytic reduction (SCR) catalysts, particulate filters, exhaust pipes, etc. These components 14 can be mounted in various different configurations and combinations dependent upon vehicle application and available packaging space.

The exhaust system 10 includes various acoustic features that dampen resonance frequencies generated during operation of the system. Examples of these acoustic features are discussed in detail below. These features can be used individually, or in various combinations, to provide the desired acoustical effect.

Figure 2:
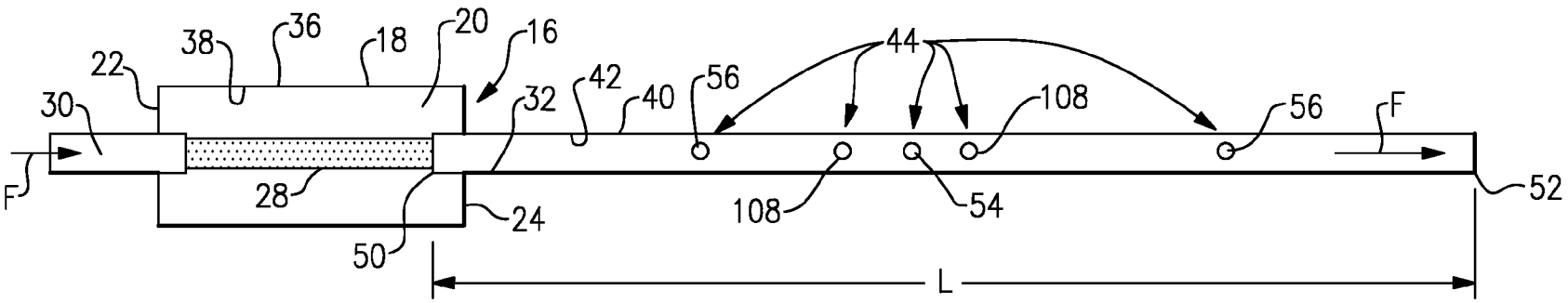
FIG. 2 schematically illustrates one example of a muffler and outlet pipe with resonance damping.

FIG. 2 shows the muffler 16 with an inlet pipe 30 at the inlet end 22 and an outlet pipe 32 at the outlet end 24. The housing 18 has an outer surface 36 and an inner surface 38 that defines the internal muffler volume of the internal cavity 20. The inlet pipe 30 and outlet pipe 32 are connected to a perforated pipe 28 that is positioned within the internal cavity 20. In another example shown in FIG. 3, the inlet 30 and outlet 32 pipes are disconnected from each other.

In one example, the outlet pipe 32 has an outer surface 40 and an inner surface 42 that defines an exhaust gas flow path F. The pipe 32 includes at least one bleed hole 44 that operates to reduce a resonance frequency. In one example, a plurality of bleed holes 44 can be formed within the pipe 32. The bleed hole 44 comprises a discontinuous opening into the exhaust gas flow path. The discontinuous opening comprises a porous opening or a structure that includes a plurality of small openings within a predefined area that allows a very small portion of exhaust gas to bleed out from the pipe 32.

The pipe 32 has a first pipe end 50 and a second pipe end 52 and is defined by an overall length L. The bleed holes 44 are especially effective when located with a 10-90% range of the overall length, i.e. the holes are not located at the pipe ends but are spaced by a distance that is at least 10% of the overall length from each pipe end. However, the bleed holes 44 are most effective when located near acoustic standing wave pressure anti-nodes (maximum pressure points). For example, in a first mode comprising a ½ wave mode, the bleed hole 44 would be located at a position that is approximately 50% of the overall length from either the first 50 or second 52 pipe end as indicated at 54. In other words, the bleed hole 44 is located near a mid-point of the pipe 32. A preferred range is 40-60% of the overall length. Holes located within this range provide an optimal amount of suppression.

In a second mode, comprising a full wave mode, the bleed holes 44 should be located at a position that is approximately 25% or 75% of the overall length from the first 50 and/or second 52 pipe end as indicated at 56. In other words, the bleed hole 44 would be located at a location that is a quarter of the overall length of the pipe when measured from either pipe end. Further, the first and second modes could be combined with holes located at locations 54 and 56.

A third mode could also be addressed with holes 44 being located at 12.5% or 37.5% locations within the pipe 32 as indicated at 108.

In the example shown in FIG. 2, the bleed holes 44 are located external to the muffler 16. In this configuration, the exhaust gas bleeds out into the external atmosphere.

Figure 3:
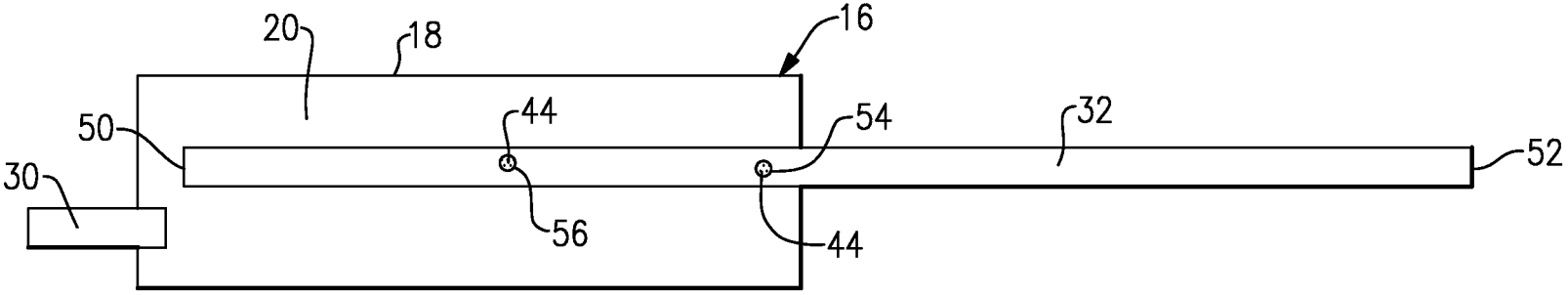
FIG. 3 schematically illustrates another example of a muffler and outlet pipe with resonance damping.

In the example shown in FIG. 3, the bleed holes bleed out into the internal volume of the muffler 16. In the example shown in FIG. 3, one hole 44 is located at the 50% location 54 and one hole 44 is located at a 25% location 56; however, additional holes could be provided at other anti-node locations.

FIGS. 2 and 3 show that the bleed holes 44 are located in the outlet pipe 32. The bleed holes 44 could also be located at the anti-node locations in the inlet pipe 30. Further, both the inlet 30 and outlet 32 pipes could include bleed holes 44 at anti-node locations.

Figure 4:
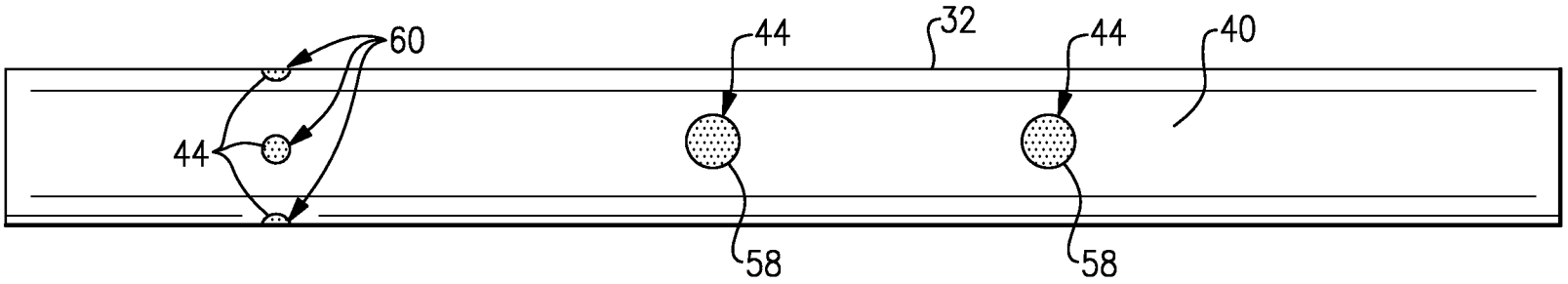
FIG. 4 schematically illustrates different examples of bleed hole configurations.

FIG. 4 shows examples of the bleed holes. The holes 44 have an opening in the outer surface 40 of the pipe. A single opening could be utilized at one location on the pipe as shown at 58, or a plurality of smaller openings could be formed in the pipe that are circumferentially spaced apart from each other as indicated at 60.

Figure 5:
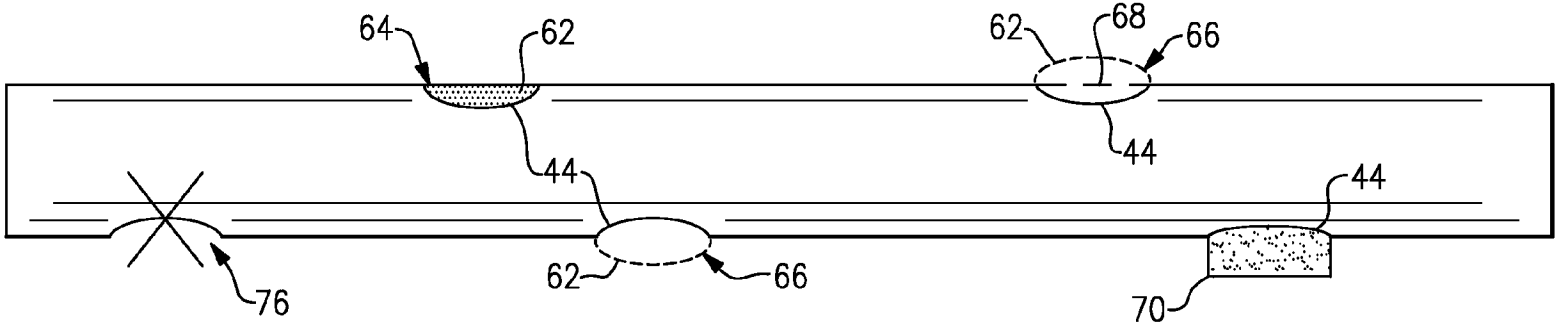
FIG. 5 schematically illustrates additional examples of bleed hole configurations.

FIG. 5 shows various examples of how the discontinuous openings are formed. In one example a sheet of microperforated material 62 is used to cover the bleed hole 44. This type of material is comprised of a sheet of material with a high density of very small openings extending through the sheet. In one example, the microperforated material has approximately 5% porosity. Optionally, a sheet of fibrous material could also be used to cover the holes 44.

To provide the desired effect, an opening of a predetermined size is cut into the pipe and then the opening is covered by the sheet of microperforated material. In one example, the opening sized to be 5% or more of the cross-sectional area of the pipe at the hole location. Thus, if the cross-sectional area is 100 $mm^2$, then the size of the opening would be 5 $mm^2$ or larger. Preferably, the opening sized to be within 5-40% of the cross-sectional area. This allows a sufficient amount of exhaust gas to bleed out for acoustic purposes without having excessive leakage.

The sheet of microperforated material 62 can be flush mounted as indicated at 64 or can comprise a cap that is offset mounted as indicated at 66. When flush mounted, the sheet of material is formed to fit the contour of the pipe. When offset mounted the material 62 extends outwardly relative to the outer surface 40 of the pipe. The sheet of microperforated material 62 can be attached to the pipe by any of various attachment methods including welding or brazing, for example. The offset configuration provides a reduced risk of grazing flow as compared to the flush mounted configuration.

In another example, the micro-perforated cap with the offset mount 66 can be used in combination with a perforated hole 68 in the pipe.

In another example, a porous boss 70 can be formed as part of, or attached separately to, the pipe. The porous boss 70 could be formed from a powdered metal material, for example. The powdered metal material can be formed to provide the desired porosity. The entire boss can be porous as shown in FIG. 5, or only a center portion 72 of the boss can be porous as shown in FIG. 6.

Figure 6:
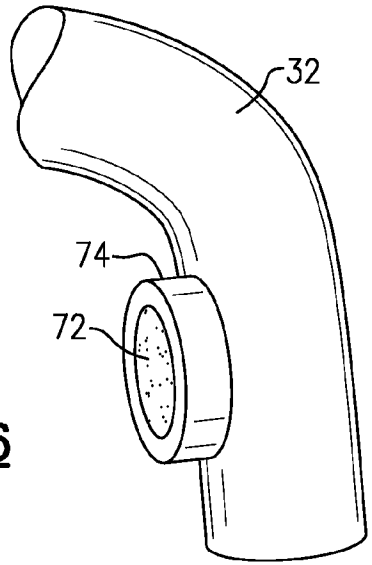
FIG. 6 schematically illustrates another example of a bleed hole configuration.

FIG. 6 shows an external boss 74 that is formed from a solid sintered metal, for example. The boss 74 can be welded or brazed to the pipe, for example. The center portion 72 can then be formed of a porous sintered metal, with porosity being determined by acoustic needs.

In these examples, the microperforated or porous material provides a specified amount of resistivity, i.e. material resistance ($Ns/m^3$). In one example, material resistance is at least 25 $Ns/m^3$. A preferred range is 50-3000 $Ns/m^3$. In another example, the material resistance is at least 160 $Ns/m^3$.

A hole with a continuous opening, as indicated at 76 in FIG. 5, is not suitable for a bleed hole for various reasons. First, this type of hole would allow a significant amount of exhaust gas to leak out from the exhaust system, which is not desirable. Second, this type of hole provides a low resistivity to flow, which makes it less suitable for addressing resonant frequencies. By using fibrous or microperforated materials, laminar flow is introduced, which maximizes acoustic energy absorption. Laminar flow burns more energy, i.e. provides more friction, which facilitates absorption. Further, covering the hole with these types of materials reduces the amount of exhaust gas that leaks out from the system.

Figure 7:
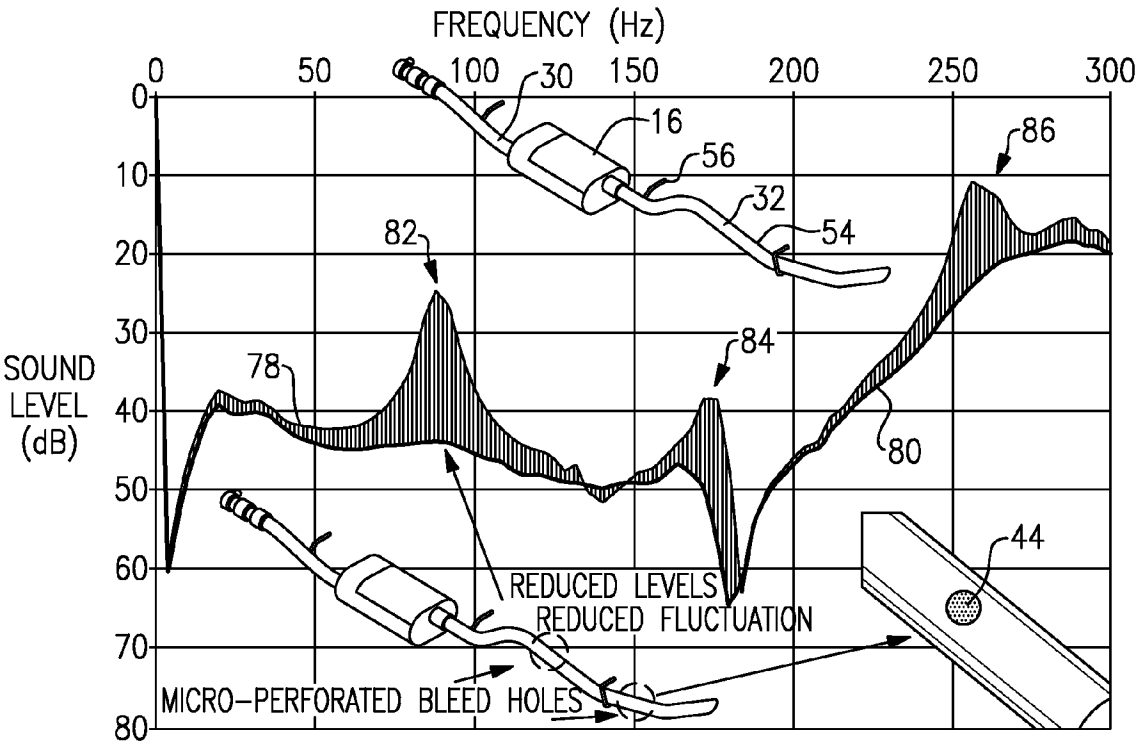
FIG. 7 is a graph of sound level (dB) v. Frequency (Hz) that illustrates the amount of noise reduction that is provided by locating bleed holes at the anti-node locations.

FIG. 7 shows an example of the amount of noise reduction that is provided by locating bleed holes at the anti-node locations. FIG. 7 is a graph of Sound Level (dB) vs. Frequency (Hz) for a system that includes the muffler 16 with the inlet pipe 30 and outlet pipe 32. An upper line 78 represents a system that does not include any bleed holes. A lower line 80 represents a system that includes at least one bleed hole 44 at the 50% location 54 and one bleed hole 44 at the 25% location 56. The lower line 80 shows significant noise reduction as compared to the upper line 78. For example, as indicated at 82, first mode resonance damping shows a significant noise reduction due to the bleed hole at the 50% location. As indicated at 84, there is also a significant noise reduction for the second mode due to the bleed hole at the 25% location. As indicated at 86, there is significant noise reduction for the third mode which is addressed in this example by the bleed hole located at the 50% location.

Figure 8:
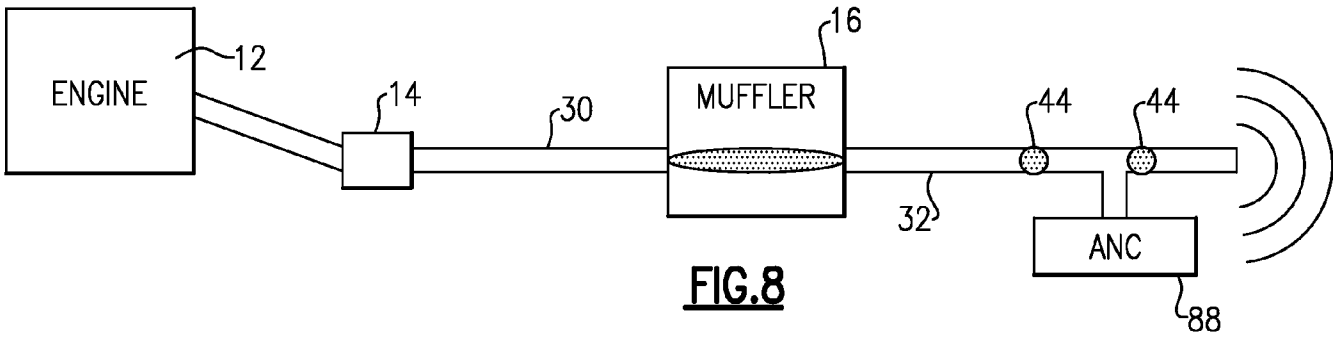
FIG. 8 schematically illustrates an example of an exhaust system with resonance damping in combination with active noise control.

In one example, a system that utilizes at least one bleed hole 44 is used with an active noise cancellation (ANC) system 88 (FIG. 8). The ANC system 88 can be positioned anywhere along the outlet pipe 32, or could be located upstream of the muffler 16. Any type of ANC system 88 could be utilized. As shown in FIG. 7, the bleed holes 44 significantly reduce the resonant frequency noise. By using the ANC system 88 in combination with the bleed holes 44, the noise level that needs to be addressed by the ANC system 88 is less than if the bleed holes were not utilized. As such, the ANC system 88 can more easily and effectively control the noise level. Further, a smaller, less expensive ANC system 88 could be used as the range of noise level that is to be controlled is smaller.

Figure 9:
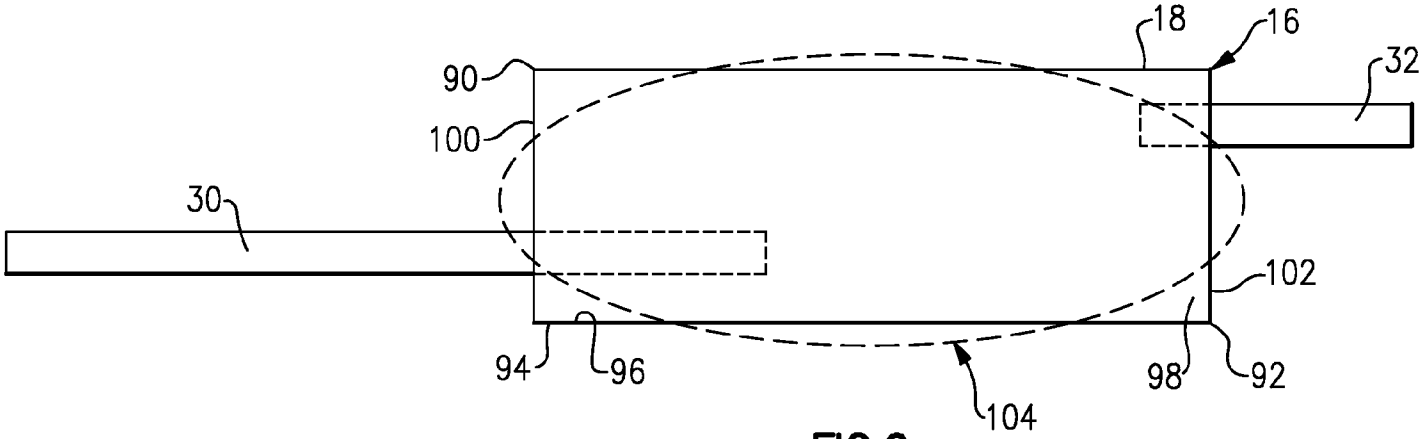
FIG. 9 schematically illustrates one example of a muffler with resonance damping.
Figure 10:
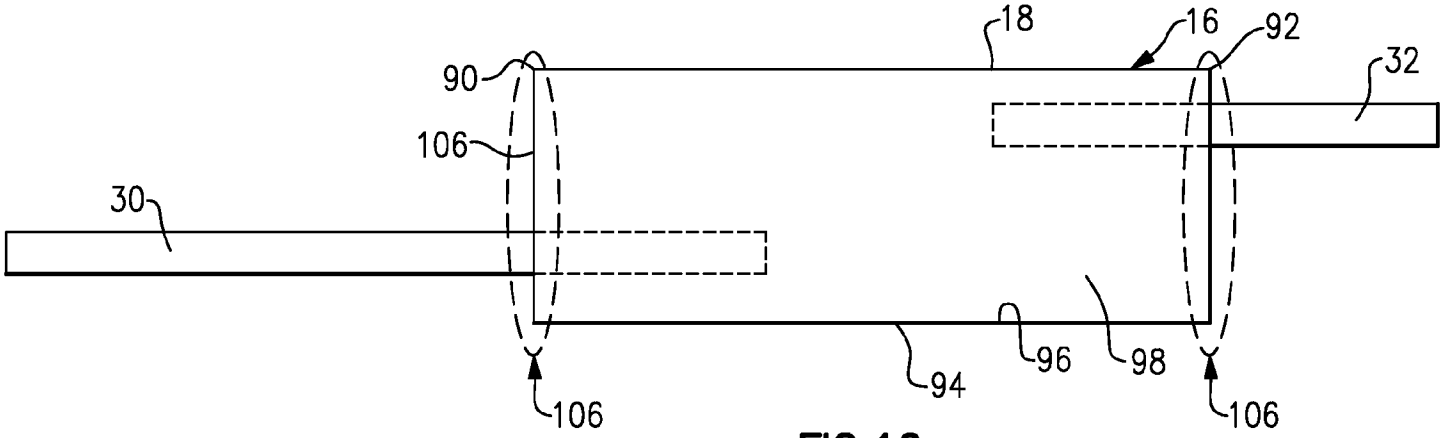
FIG. 10 schematically illustrates another example of a muffler with resonance damping.
Figure 11:
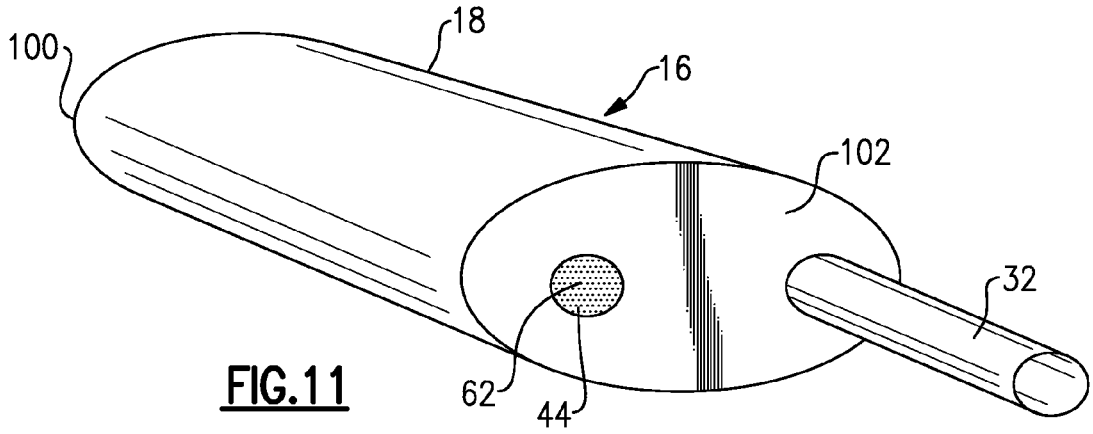
FIG. 11 schematically illustrates one example of a muffler with a bleed hole in an end cap.

FIGS. 9-11 show locations for bleed holes for muffler resonance damping. The muffler 16 has a housing 18 extending from a first end 90 to a second end 92. The housing 18 has an outer surface 94 and an inner surface 96 that defines an internal muffler volume 98. The muffler 16 includes a first end cap 100 associated with the first end 90 and a second end cap 102 associated with the second end 92.

As discussed above, resistive bleed holes 44 work well at pressure anti-nodes in pipes. For lumped parameter modes, pressure anti-nodes are located anywhere within the muffler 16. For muffler standing waves, pressure anti-nodes are located in muffler end caps 100, 102.

In a lumped parameter mode the exhaust gas acts like a single lumped mass with the muffler 16 acting as a spring. This is referred to as a Helmholtz resonance. As shown in FIG. 9, in order to address the lumped parameter mode (low frequencies), one or more bleed holes 44 can be located anywhere on the muffler housing 18 or end caps 100, 102 as indicated at 104. The bleed hole 44 would be configured in a manner as described above.

In standing wave mode, e.g. ½ waves or full waves, the exhaust gas acts like a spring. As shown in FIG. 10, in order to address muffler standing waves one or more bleed holes 44 would be located on either or both of the end caps 100, 102 as indicated at 106. FIG. 11 shows one example of a bleed hole 44 being located on the second end cap 102 adjacent to the outlet pipe 32. In this example, the bleed hole 44 comprises an opening that is covered with microperforated material in a flush mount; however, other bleed hole configurations, as described above, could also be used.

As discussed above, the microperforated or porous material provides a specified amount of resistivity, i.e. material resistance ($Ns/m^3$). When used in a muffler configuration, in one example, the material resistance is at least 25 $Ns/m^3$. In another example, the material resistance is at least 160 $Ns/m^3$. A preferred range is 50-3000 $Ns/m^3$.

The size of the bleed hole for the muffler is determined based on muffler volume. Muffler volumes typically range from 2-3 liters for smaller vehicles up to 30-40 liters for larger vehicles. The bleed hole is preferably sized such that there is at least 25 $mm^2$ for each liter of muffler volume. Thus, if the muffler has a 2 liter volume, the hole would be sized to be at least 50 $mm^2$. The preferred range would be 100-1000 $mm^2$ for each liter of muffler volume. Thus, if the muffler has a 2 liter volume, the hole would be sized to be at least 200-2000 $mm^2$ for the preferred range. Once the hole size is selected it would then be covered with the microperforated or porous material.

Figure 12:
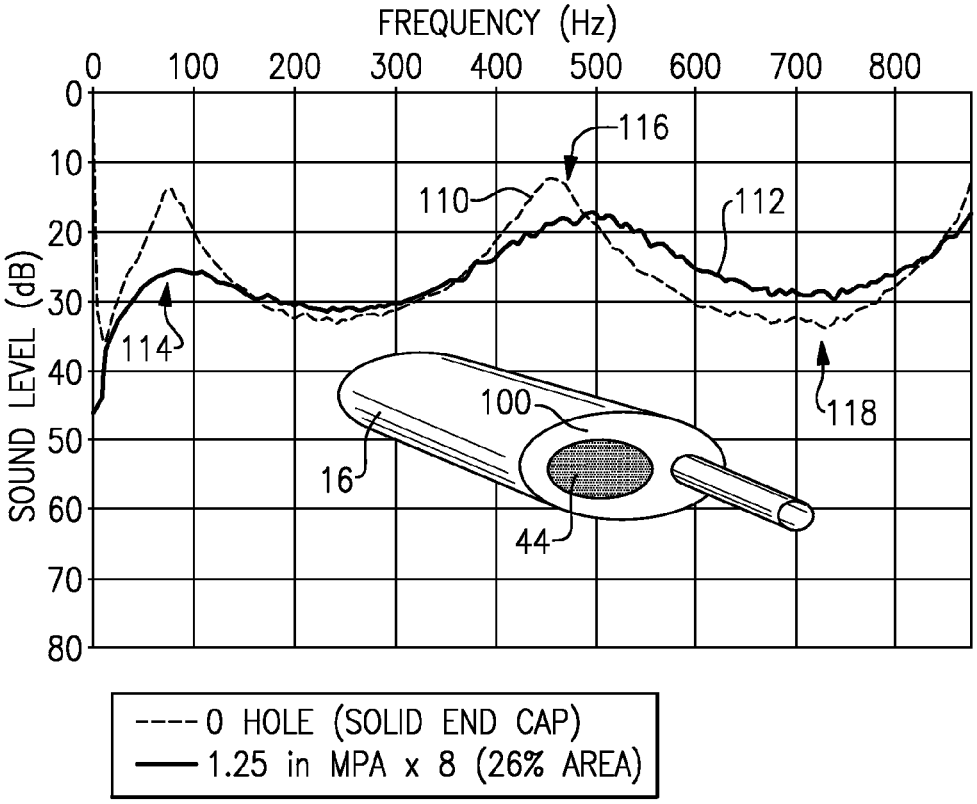
FIG. 12 is a graph of sound level (dB) v. Frequency (Hz) that compares optimized damping to a non-damped component.

FIG. 12 shows an example of noise reduction when a bleed hole 44 is included in one of the end caps 100, 102. FIG. 12 is a graph of Sound Level (dB) vs. Frequency (Hz). A first line 110 represents a system that does not include a bleed hole in the end cap. A second line 112 represents a system that includes a bleed hole 44 in the end cap 100. The second line 112 shows significant noise reduction as compared to the first line 110. The most significant noise reduction occurs at the Helmholtz mode, which is indicated at 114. The ½ wave mode is indicated at 116 and the full wave mode is indicated at 118.

The bleed holes in the mufflers can be used by themselves, or they can be used in combination with bleed holes in pipes. As discussed above, there are pressure anti-node locations for a family of resonances in the system. Lumped parameter modes (low frequencies), i.e. Helmholtz mode, have resonance damping provided by bleed holes located anywhere within the muffler (housing or end caps) as shown in FIG. 9. For pipe standing waves, resonance damping is provided by pipe bleed holes that are located at 25%, 50%, 75%, etc., locations within a pipe as shown in FIGS. 2-4. For muffler standing waves, resonance damping is provided by locating a bleed hole on an end cap as shown in FIGS. 10-11.

Figure 13:
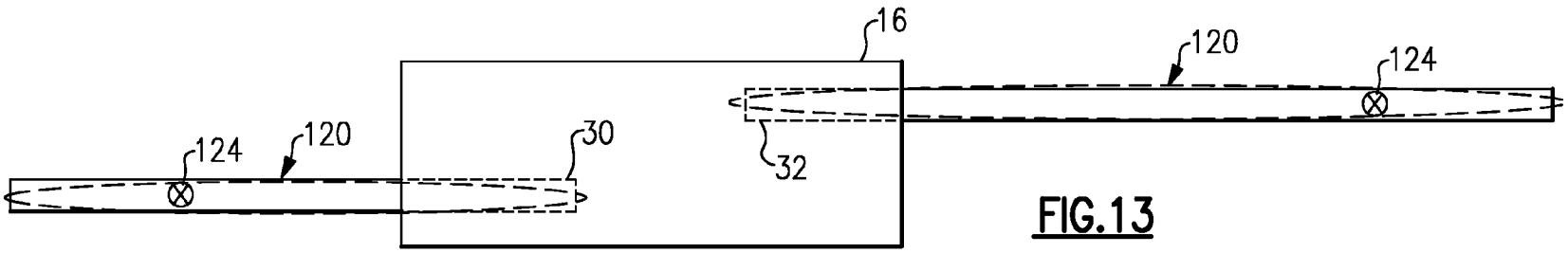
FIG. 13 schematically illustrates one example of velocity anti-node locations for lumped parameter modes (low frequencies).
Figure 14:
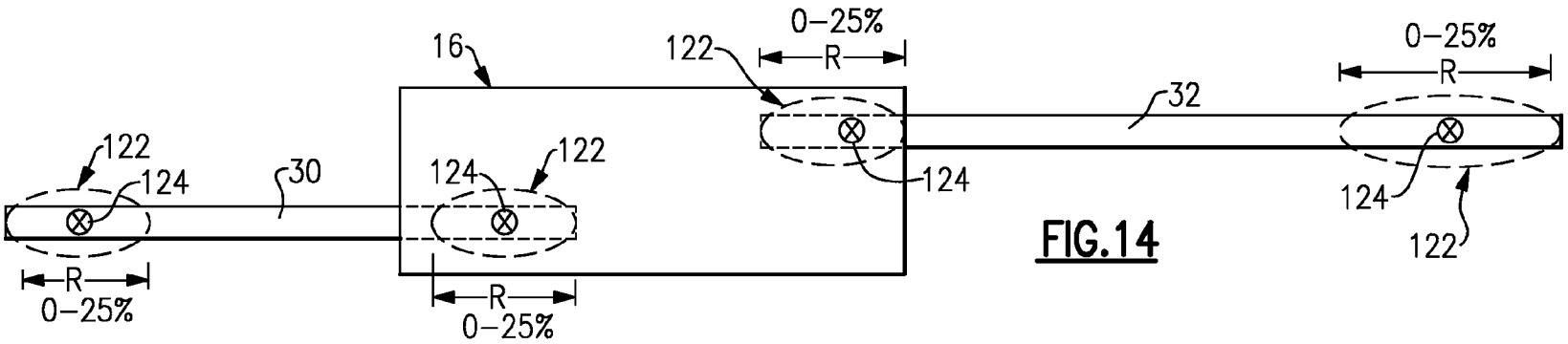
FIG. 14 schematically illustrates one example of velocity anti-node locations for pipe standing waves.
Figure 15:
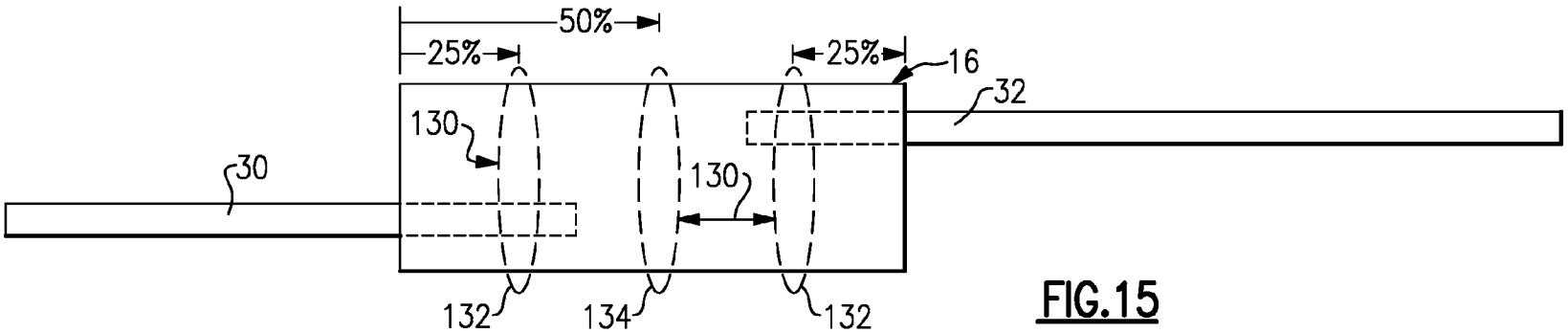
FIG. 15 schematically illustrates one example of velocity anti-node locations for muffler standing waves.

There are also velocity anti-node (velocity maximums) locations for each family of resonances as shown in FIGS. 13-15. Lumped parameter modes (low frequencies), i.e. Helmholtz mode, are suppressed by providing an adaptive valve or other throttling valve 124 anywhere inside of the inlet 30 or outlet 32 pipes, as indicated at 120 in FIG. 13. Any type of valve could be utilized, including actively controlled or passively controlled valves.

Pipe standing wave resonances are suppressed by providing an adaptive valve or other throttling valve 124 at a predetermined location within the inlet 30 or outlet 32 pipe as indicated at 122 in FIG. 14. In one example, the valve 124 is located anywhere within a range R of 0-25% of an overall length of the pipe starting from one end of the pipe. Only one valve 124 may be used, or a combination of valves 124 could be used.

Further, the ANC system 88 (FIG. 8) could be used in combination with any of the valve configurations described above. This would allow the ANC system 88 to be even more compact and would further reduce cost.

Muffler standing wave resonances are suppressed by using high resistivity baffles 130 as shown in FIG. 15. The baffles 130 can be located at 25% locations (indicated at 132) and/or at a 50% location (indicated at 134) relative to the overall length of the muffler 16. A single baffle 130 could be used at one of these locations 132, 132 or a combination of baffles 130 could be used at these locations 132, 134. In one example, the baffle 130 is comprised of a microperforated material. The baffle 130 could serve only as a flow restriction within the muffler 16 as shown at the 50% location 134. Or, the baffle 130 could serve as a flow restriction and as an additional support structure for the inlet 30 and/or outlet 32 pipe as shown at the 25% locations 132.

Figure 16:
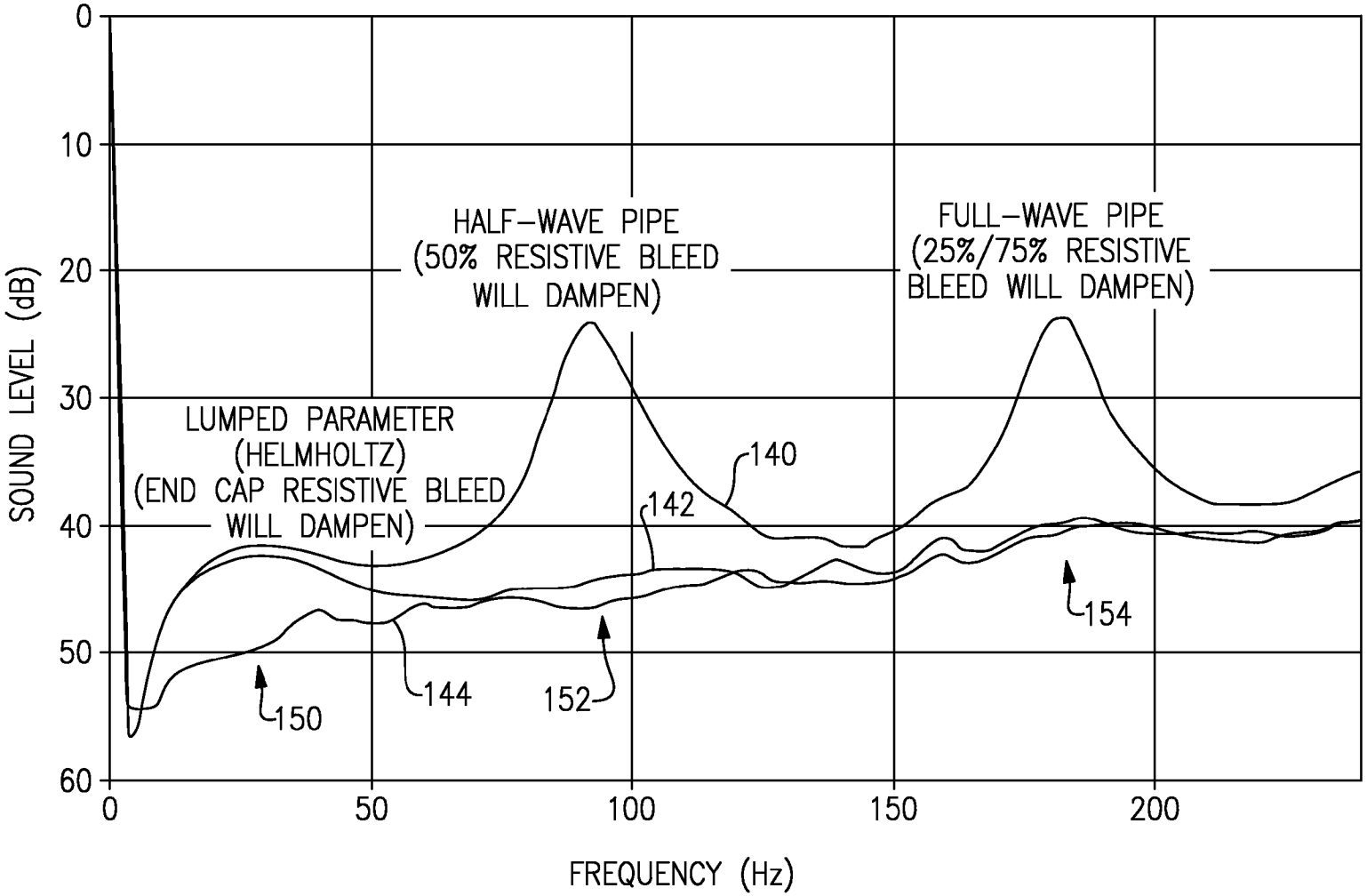
FIG. 16 is a graph of sound level (dB) v. Frequency (Hz) that illustrates a comparison of a standard exhaust system without bleed holes, a system with pipe bleed holes at 25% and 50% locations, and a system with pipe bleed holes at 25% and 50% locations and with a muffler end cap bleed hole.

FIG. 16 shows a comparison of a standard exhaust system without bleed holes, a system with pipe bleed holes at 25% and 50% locations, and a system with pipe bleed holes at 25% and 50% locations and with a muffler end cap bleed hole. FIG. 16 is a graph of Sound Level (dB) vs. Frequency (Hz). An upper line 140 represents the standard exhaust system without bleed holes. A middle line 142 represents the system with pipe bleed holes at 25% and 50% locations. A lower line 144 represents the system with pipe bleed holes at 25% and 50% locations and with a muffler end cap bleed hole. The lumped parameter (Helmholtz) damping provided by the muffler end cap is indicated at 150. The ½ wave pipe damping provided by the bleed hole at the 50% location is indicated at 152. The full wave damping provided by the bleed hole at the 25% and/or 75% location is indicated at 154. The middle 142 and lower 144 lines show similar noise reduction for the ½ wave and full wave modes; however, the lower line 144 shows a more significant reduction for the lumped parameter mode. Thus, combining the muffler end cap bleed hole with bleed holes in the pipe provides the most significant overall noise reduction over a wider range than only using pipe bleed holes.

Figure 17C:
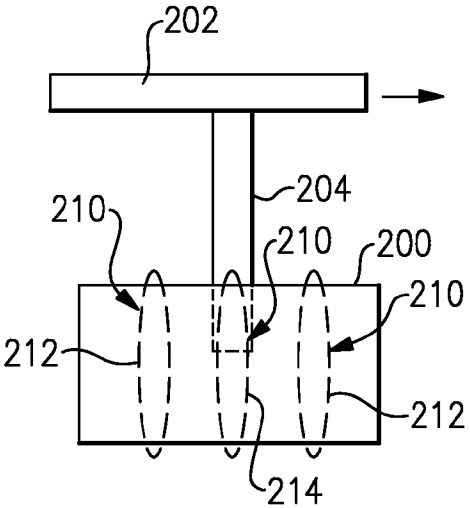
FIG. 17C schematically illustrates one example of velocity anti-node locations for muffler standing waves in a Helmholtz resonator configuration.
Figure 17B:
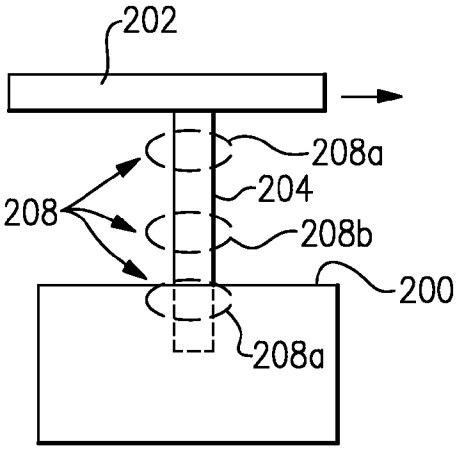
FIG. 17B schematically illustrates one example of pressure anti-node locations for pipe standing waves in a Helmholtz resonator configuration.
Figure 17A:
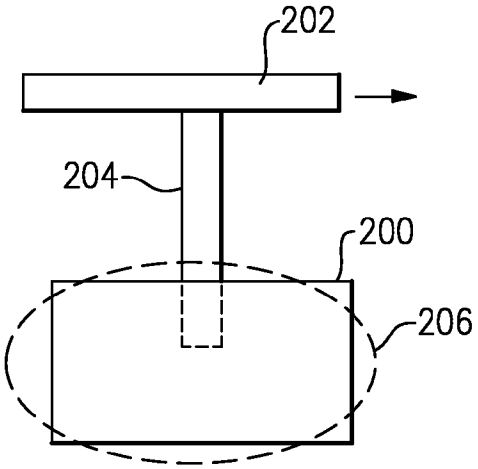
FIG. 17A schematically illustrates one example of pressure anti-node locations for lumped parameter modes (low frequencies) in a Helmholtz resonator configuration.

FIGS. 17A-C show examples of pressure anti-node locations for each family of resonances in a Helmholtz resonator configuration. In this configuration a muffler 200 is located on a side branch from a main exhaust gas flow path pipe 202, i.e. the main exhaust gas flow bypasses the muffler 200. A side pipe 204 connects the muffler 200 to the main exhaust gas flow path pipe 202. Lumped parameter modes (low frequencies) are suppressed by providing a bleed hole (as described above) anywhere with the muffler 200 as schematically indicated at 206 in FIG. 17A.

Pipe standing wave resonances are suppressed by providing the bleed hole(s) at a predetermined location within the side pipe 204 as indicated at 208 in FIG. 17B. In one example, the bleed hole is located anywhere within a range R of 0-25% of an overall length of the pipe 204 starting from one end of the pipe as indicated at 208*a*. The bleed hole could also be located at a 50% location as indicated at 208*b*. A single bleed hole could be located at any one of these positions or multiple bleed holes could be utilized at any combination of these positions.

Muffler standing wave resonances are suppressed by using high resistivity baffles 210 as shown in FIG. 17C. The baffles 210 can be located at 25% locations (indicated at 212) and/or at a 50% location (indicated at 214) relative to the overall length of the muffler 200. A single baffle 210 could be used at one of these locations 212, 214 or a combination of baffles 210 could be used at these locations 212, 214. In one example, the baffle 210 is comprised of a microperforated material.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A vehicle exhaust system comprising:

a pipe having an outer surface and an inner surface that defines an internal exhaust component cavity configured to receive hot exhaust gases, and wherein the a pipe extends along a center axis from a first pipe end to a second pipe end;

at least one additional component positioned upstream or downstream of the pipe;

at least one first bleed hole formed in the pipe at a first anti-node position to reduce a resonance frequency, the at least one first bleed hole comprising an opening into the internal exhaust component cavity;

at least one second bleed hole formed in the additional component or in the pipe at a second anti-node position axially spaced from the first anti-node position along the center axis to reduce resonant frequency; and a discontinuous member that covers each bleed hole at the inner or outer surface.

2. The vehicle exhaust system according to claim 1 wherein the pipe is defined by an overall length, and wherein the at least one first bleed hole is located at the first anti-node position that is approximately 25% of the overall length from either the first or second pipe end.

3. The vehicle exhaust system according to claim 1 wherein the pipe is defined by an overall length, and wherein the at least one first bleed hole is located at the first anti-node position that is approximately 50% of the overall length from either the first or second pipe end.

4. The vehicle exhaust system according to claim 1 wherein the pipe is defined by an overall length, and wherein the first bleed hole is located at the first anti-node position that is approximately 25% of the overall length from the first pipe end and the second bleed hole is located at the second anti-node position that is approximately 25% of the overall length from the second pipe end.

5. The vehicle exhaust system according to claim 1 wherein the discontinuous member comprises a porous member.

6. The vehicle exhaust system according to claim 1 wherein the discontinuous member comprises a sheet of microperforated material that is attached to the pipe or additional component and covers each of the first and second bleed holes.

7. The vehicle exhaust system according to claim 5 wherein the porous member comprises a boss, the boss being formed from a powdered or sintered metal material.

8. The vehicle exhaust system according to claim 1 wherein the at least one first bleed hole is located external to the at least one additional component, and wherein the at least one first bleed hole comprises a plurality of first bleed holes that are circumferentially spaced apart from each other about the center axis.

9. The vehicle exhaust system according to claim 1 wherein the at least one second bleed hole is located within an internal cavity defined by the additional component such that the second bleed hole is enclosed within the additional component.

10. A vehicle exhaust system comprising:

a muffler having an outer surface and an inner surface that defines an internal exhaust component cavity configured to receive hot exhaust gases, and wherein the muffler has a housing extending from a first end to a second end such that the inner and outer surfaces define an internal muffler volume, the muffler including a first end cap associated with the first end and a second end cap associated with the second end;

at least one first bleed hole formed in the muffler to reduce a resonance frequency, the at least one first bleed hole in communication with the internal muffler volume;

at least one pipe connected to the muffler, the at least one pipe comprising a muffler inlet pipe or a muffler outlet pipe;

at least one second bleed hole formed in the at least one pipe; and a discontinuous member that covers each bleed hole.

11. The vehicle exhaust system according to claim 10 wherein the at least one first bleed hole is located in the housing.

12. The vehicle exhaust system according to claim 10 wherein the at least one first bleed hole is located within at least one of the first and second end caps.

13. The vehicle exhaust system according to claim 10 wherein the discontinuous member is provided by a porous member that covers each bleed hole.

14. The vehicle exhaust system according to claim 1 wherein the at least one additional component comprises a muffler that is coupled to the pipe, and wherein the discontinuous member for the first bleed hole is provided by a porous member that covers the at least one first bleed hole, and wherein the at least one first bleed hole is located externally of the muffler.

15. The vehicle exhaust system according to claim 1 wherein the discontinuous member for at least one of the first or second bleed holes comprises a boss located at the associated bleed hole, the boss being formed from a powdered or sintered metal material.

16. The vehicle exhaust system according to claim 1 including an active noise cancellation system.

17. A vehicle exhaust system comprising:

an exhaust component having an outer surface and an inner surface that defines an internal exhaust component cavity configured to receive hot exhaust gases, and wherein the exhaust component comprises at least first and second pipes;

a muffler connected to the first and second pipes such that one of the first and second pipes comprises a muffler inlet pipe and the other of the first and second pipes comprises a muffler outlet pipe that is disconnected from the muffler inlet pipe, the muffler including a housing defining an internal muffler volume and first and second end caps attached to respective opposing ends of the housing;

at least one first bleed hole formed in at least one of the muffler inlet and outlet pipes at an anti-node position to reduce a resonance frequency;

at least one second bleed hole formed in the muffler;

a discontinuous member that overlaps each bleed hole; and at least one valve located within at least one of the muffler inlet and outlet pipes.

18. A vehicle exhaust system comprising:

an exhaust component having an outer surface and an inner surface that defines an internal exhaust component cavity configured to receive hot exhaust gases, wherein the exhaust component comprises at least one exhaust pipe;

a muffler connected to the at least one exhaust pipe, the muffler including a housing defining an internal muffler volume and first and second end caps attached to respective opposing ends of the housing;

at least one first bleed hole formed in the exhaust component and at least one second bleed hole formed in the muffler to reduce a resonance frequency, the at least one first bleed hole comprising a first discontinuous opening into the internal exhaust component cavity and the at least one second bleed hole comprising a second discontinuous opening into the internal muffler volume, and wherein each discontinuous opening includes a discontinuous member that covers the bleed hole at the inner or outer surface such that exhaust gas is configured to bleed out through the discontinuous member from the internal exhaust component cavity and the internal muffler volume to atmosphere; and a valve located within the at least one exhaust pipe.

19. The vehicle exhaust system according to claim 18 wherein the pipe is defined by an overall length, and wherein the valve is located at an anti-node position within the pipe that is approximately 25% or less of the overall length from either the first or second pipe end.

20. The vehicle exhaust system according to claim 17 including at least one baffle positioned within the internal muffler volume.

21. The vehicle exhaust system according to claim 20 wherein the at least one baffle is comprised of a microperforated material.

22. The vehicle exhaust system according to claim 20 wherein the at least one baffle supports one of the inlet and outlet pipes.

23. The vehicle exhaust system according to claim 1 wherein the pipe is defined by an overall length, and wherein the at least one first bleed hole is located at the first anti-node position that is approximately 40-60% of the overall length from either the first or second pipe end.

24. The vehicle exhaust system according to claim 1 wherein the discontinuous member provides a material resistance that is at least 25 $Ns/m^3$.

25. The vehicle exhaust system according to claim 1 wherein the discontinuous member provides a material resistance that is within a range of 50-3000 $Ns/m^3$.

26. The vehicle exhaust system according to claim 1 wherein the discontinuous member comprises resistive material that covers each bleed hole, and wherein each bleed hole is sized to be at least 5% of a cross-sectional area of the pipe at a location of the bleed hole.

27. The vehicle exhaust system according to claim 1 wherein each bleed hole is covered by a resistive material that forms the discontinuous member, and wherein each bleed hole is sized to be within a range of 5%-40% of a cross-sectional area of the pipe at an associated hole location.

28. The vehicle exhaust system according to claim 1 wherein the at least one additional component comprises a muffler that includes the second bleed hole which is covered by a resistive material that forms the discontinuous member, and wherein the second bleed hole is sized to be at least 25 $mm^2$ for each liter of muffler volume.

29. The vehicle exhaust system according to claim 1 wherein the at least one additional component comprises a muffler that includes the second bleed hole which is covered by a resistive material that forms the discontinuous member, and wherein the second bleed hole is sized to be at least 100-1000 $mm^2$ for each liter of muffler volume.

30. The vehicle exhaust system according to claim 1 wherein the at least one additional component comprises a Helmholtz resonator.

31. The vehicle exhaust system according to claim 30 wherein the Helmholtz resonator comprises a muffler connected to the pipe with a side pipe, and wherein the at least one second bleed hole is located anywhere within the muffler.

32. The vehicle exhaust system according to claim 30 wherein the Helmholtz resonator comprises a muffler connected to the pipe with a side pipe, and wherein the side pipe is defined by an overall length, and wherein the at least one first bleed hole is located at the first anti-node position that is approximately 25% of the overall length from either the first or second pipe end and/or at 50% of the overall length from either the first or second pipe end.

33. The vehicle exhaust system according to claim 30 wherein the Helmholtz resonator comprises a muffler connected to the pipe with a side pipe, and wherein the muffler is defined by an overall length, and including at least one baffle located at a position that is approximately 25% of the overall length from either muffler end and/or at 50% of the overall length from either muffler end.

34. The vehicle exhaust system according to claim 14 wherein the muffler defines an internal muffler volume, and wherein the pipe comprises a first pipe and including a second pipe coupled to the muffler such that one of the first and second pipes comprises a muffler inlet pipe and the other of the first and second pipes comprises a muffler outlet pipe that is disconnected from the muffler inlet pipe, and wherein each of the muffler inlet and outlet pipes has a first pipe end enclosed within the internal muffler volume and a second pipe end that extends outwardly from the muffler, and wherein the at least one first bleed hole is located within one of the second pipe ends.

35. The vehicle exhaust system according to claim 34 and wherein the first bleed hole is located externally of the muffler in one of the first and second pipe ends and the second bleed hole is enclosed within the internal muffler volume and formed in one of the first pipe ends.

36. The vehicle exhaust system according to claim 34 wherein the first bleed hole is located externally of the muffler in one of the first and second pipe ends and the second bleed hole is formed in the muffler.

37. The vehicle exhaust system according to claim 17 wherein the at least one valve comprises at least a first valve located in the muffler inlet pipe and a second valve located in the muffler outlet pipe.

38. The vehicle exhaust system according to claim 37 wherein at least one of the first and second valves is positioned within the internal muffler volume.

* * * * *